United States Patent [19]

Humbs

[11] Patent Number: 4,502,805

[45] Date of Patent: Mar. 5, 1985

[54] DEVICE FOR LINE PRINTERS FOR THE DEPOSITING OF SHEET-LIKE DATA CARRIERS

[75] Inventor: Rolf Humbs, Munich, Fed. Rep. of Germany

[73] Assignee: Siemens Aktiengesellschaft, Berlin & Munich, Fed. Rep. of Germany

[21] Appl. No.: 511,919

[22] Filed: Jul. 8, 1983

[30] Foreign Application Priority Data

Jul. 30, 1982 [DE] Fed. Rep. of Germany ..... 3228620

[51] Int. Cl.[3] ..... B41J 11/00

[52] U.S. Cl. ..... 400/647.1; 400/625; 400/646; 271/186; 271/212; 271/220; 271/292

[58] Field of Search ..... 400/624, 625, 629, 636, 400/646, 647, 647.1; 101/240, 93; 271/186, 212, 220, 292

[56] References Cited

U.S. PATENT DOCUMENTS 1,213,189 1/1917 Hart ..... 400/636 X
4,113,244 9/1978 Ruenzi ..... 271/186 X
4,354,055 10/1982 Koller et al. .

FOREIGN PATENT DOCUMENTS 0054327 6/1982 European Pat. Off. ..... 400/625
0045640 10/1982 European Pat. Off. .
2856950 10/1979 Fed. Rep. of Germany .

OTHER PUBLICATIONS

IBM Technical Disclosure Bulletin, "Sheet Receiving Tray" by Wing, vol. 17, No. 4, 9-1974, p. 1135.

*Primary Examiner*—Edgar S. Burr
*Assistant Examiner*—John A. Weresh
*Attorney, Agent, or Firm*—Hill Van Santen, Steadman & Simpson

[57] ABSTRACT

A deposit container for printers for the deposition of sheet-like data carriers which are delivered by means of a platen is pivotably disposed above the platen to permit selective sheet stacking in upwards or downwards sequence. A pair of transport rollers are arranged adjacent the accepting end opening of the deposit container to be spread apart during sheet introduction into the container and to be moved together to form a drive nip for the sheet after it has passed through the printing zone and lift it into the deposit container. Pivotal flap valves are mounted on the container walls, which are adjusted in dependence upon the pivot position of the deposit container to assist the deposition of the individual sheets.

5 Claims, 4 Drawing Figures

DEVICE FOR LINE PRINTERS FOR THE DEPOSITING OF SHEET-LIKE DATA CARRIERS

BACKGROUND OF THE INVENTION

The invention concerns an arrangement for transporting recording medium sheets from a printing platen area into a deposit tray such that the individual printed sheets can be optionally stacked in the deposit tray in an upwards or downwards sequence.

Printing device assemblies for conducting recording medium sheets from a printing platen area into a deposit tray are known in the art. One such sheet deposit system for an office printing machine is disclosed in German OS No. 28 56 950. In this system, the sheet to be printed is drawn from a feed box, with the assistance of transport rollers which are driven by the platen and arranged in the conveyance path of the sheet. By means of other transport rollers arranged above the platen, the sheet is then gripped and stacked in a deposit box. In order to allow individual sheets to be deposited, an additional vertical supply shaft is provided in which individual sheets can be inserted which are fed through this additional supply shaft to the input of the platen.

In all sheet transport devices of this kind in which the data carriers are withdrawn from a feed box and transported via the platen to a deposit tray or box, the problem exists that the order of the sheets stacked in the boxes is reversed. This means that the uppermost sheet of the data carriers stacked in the feed box finds itself as the bottom sheet in the deposit box at the end of the printing process. The depositing of individual sheets in deposit boxes where the first printed sheet occupies the lowest position at the end of the printing process will be referred to hereafter as upwards sequence depositing. If the individual sheets are deposited in such manner that, viewed from the printing area, the uppermost sheet in the deposit box stack corresponds to the first individual sheet to have been printed by the printer during the printing process, this will hereafter be referred to as downwards sequence depositing.

An object of the invention is to provide printers with a printed sheet deposit device which allows the individual sheets to be deposited optionally in upwards sequence or in downwards sequence.

SUMMARY OF THE INVENTION

A deposit tray for stacking recording medium sheets passing from a printing platen of a printer machine is pivotable about a sheet transport roller above and driven from the platen between upwards and downwards deposit sequence positions. The deposit tray is formed with opposed halves selectively brought together and each having transport roller means adjacent the sheet input end thereof to form a sheet delivery drive nip therebetween when the opposed halves are brought together.

DESCRIPTION OF THE PREFERRED EMBODIMENT

Figure 1:
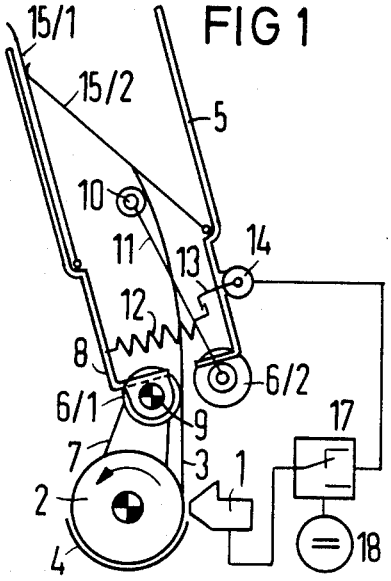
FIG. 1 is a schematic sectional view of the inventive sheet depositing device during the printing process where the deposition takes place in upwards sequence.
Figure 2:
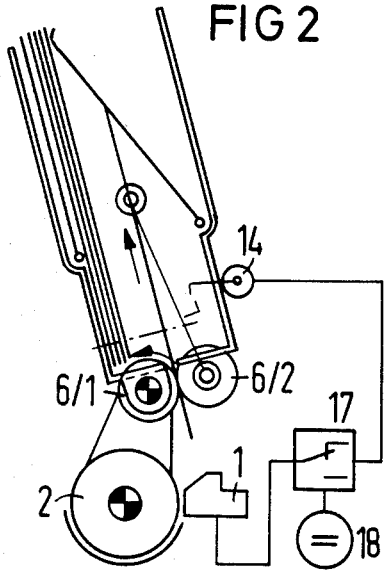
FIG. 2 schematically illustrates the device of FIG. 1 at the end of the printing process during the deposition of the last individual sheet.

FIGS. 1 and 2 generally illustrate a line printer assembly, such as a teletypewriter. During the printing operation, occurring in FIG. 1, a printing head 1 is moved in the usual way line by line along a data carrier 3 which is extended over a rotary platen 2. The data carriers consist of individual sheets which are transported with the assistance of the motor driven platen 2 from the rear towards the front by a curved paper guide 4 in accordance with the progress of the printing operation.

Disposed above the platen 2 is a deposit tray or container 5 which serves to receive the individual printed sheets and to stack these one on top of the other inside the container. In the output region of the platen, above the platen, and connected near opposed edges of a sheet input or accepting end 8 of the deposit container, there are arranged two transport rollers 6/1 and 6/2. The accepting end 8 of the container 5 is longitudinally divided into opposed halves, each of which is respectively connected to the transport rollers. The left transport roller 6/1 is coupled to the drive device of the platen 2 via, for example, a belt 7 and is driven by said drive device. The accepting end 8 of the deposit container 5 rests on a bearing axis 9 of the left-hand driven transport roller 6/1 and can be pivoted about this bearing axis 9.

The transport rollers are arranged in pairs and, although this cannot be seen from the sectional drawing, are each mounted at the edges of the deposit container so that the individual sheets can be transported without creasing.

The deposit container 5 is designed to be such that the individual sheets which are transported to the deposit container 5 can be stacked both in upwards and in downwards sequence. For this purpose, the right-hand transport roller 6/2 is mounted at the other side of the accepting end of the containers so as to be pivotable about a pivot 10. This arrangement of the transport rollers permits an insertion opening 16 for the introduction of the individual sheets into the container. By means of a pivot arm 11 connection, the right-hand transport roller 6/2 is positioned by a spring 12 which is connected via a latch device 13 to a rotary magnet 14 which serves to actuate the latch device. The pivot arm 11 also engages the corresponding half of the accepting end 8 adjacent the transport roller 6/2.

In the deposit container 5, pivotal flap valves 15 are mounted on the front and rear depositing surfaces and serves to assist the paper deposition.

The deposit device for individual sheets functions as follows. In order that the individual sheets may be deposited in upwards sequence, i.e. in a sequence in which the first printed paper comes to occupy the bottom position when the stack of paper is removed from the deposit container, the deposit container 5 is pivoted backwards about the bearing axis 9 as shown in FIGS. 1 and 2. An individual sheet 3 is transported from the rear via the platen 2 towards the printing position opposite the printing head 1. In order to simplify the insertion of the individual sheet into the deposit container 5, the transport rollers 6/1 and 6/2 are moved aprt from one another via the latch device 13 so as to form the wide insertion opening 16. The individual sheet is now moved upwards into the deposit container 5 via rotation of the platen, such that its upper edge abuts against the right-hand flap 15/2 which has been pivoted towards the left by which it is diverted. The flap valves 15 are mounted in such a way that its force of gravity allows it to assume the various positions shown in FIGS. 1 and 3 simply by the pivoting of the depositing container 5.

The latch device 13 is actuated via the rotary magnet 14 which itself is triggered by a switch 17 from a d.c. voltage source 18 with appropriately poled current in accordance with the desired direction of rotation. The switch 17 is controlled by the printer electronics via the printing head 1 so that the transport rollers are spaced apart during the printing process. At the end of the printing process, in order that the individual sheet 3 may be actually deposited in the deposit container 5, the rotary magnet 14 is operated by means of the switch 17 so that the right-hand transport roller 6/2 contacts the left-hand transport roller 6/1 under the influence of the spring 12 and thereby exerts pressure onto the sheet which has been introduced into the nip defined between the transport rollers. The individual sheet 3 is passed into the deposit container 5 by the frictional drive force emanating from the left-hand transport roller 6/1.

The pivoted position of the deposit container 5 enables the desired deposition in upwards sequence, as shown in FIG. 2, such that the individual sheet is deposited towards the left. This deposition is primarily achieved by the direction of rotation of the left-hand transport roller 6/1. Additional assistance is provided by the right-hand pivot flap 15/2 which is pivoted towards the left.

Figure 3:
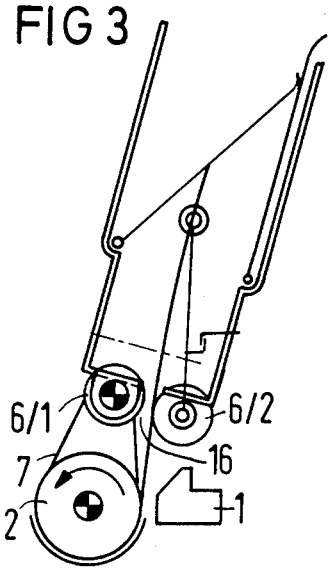
FIG. 3 schematically illustrates the inventive sheet depositing device during the printing process where the deposition of the individual sheets takes place in downwards sequence.
Figure 4:
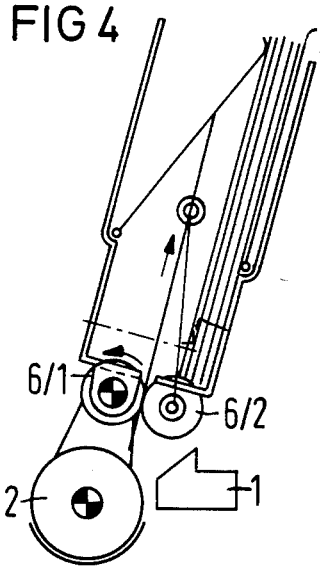
FIG. 4 schematically illustrates the device of FIG. 3 at the end of the printing process during the deposition of the last printed individual sheet.

If, as shown in FIGS. 3 and 4, the individual sheets are to be deposited in downwards sequence, the deposit container 5 is pivoted forward, towards the right, about the bearing axis 9. The individual sheets are deposited so that the first printed sheet is deposited on the right-hand container wall of the deposit container 5 with the printed side directed towards the right-hand depositing surface. Here, the last printed individual sheet is arranged at the bottom of the stack when the stack of individual sheets are removed from the depositing container. Therefore, considered from the bottom sheet, the individual sheets are stacked in a downwards sequence. The left-hand pivot flap 15/1 is now pivoted to the right to assist in deflecting incoming sheets accordingly against the right side of the container 5. Otherwise, the sheet driving sequence and operation is the same as described above in connection with upwards sequence stacking.

The flap valves 15 may consist of one single, centrally pivotable flap which is turned for example via magnets. In place of the latch device which controls the right-hand transport roller it is possible to use direct electromagnets or similar drive devices. Naturally it is also possible to drive the transport rollers 6 independently of the drive of the platen 2.

Although various minor modifications may be suggested by those versed in the art, it should be understood that I wish to embody within the scope of the patent warranted hereon all such modifications as reasonably and properly come within the scope of my contribution to the art.

I claim as my invention:

1. Apparatus for use in a printing device for depositing sheet-type recording media transported through a printing area by a platen comprising a deposit tray disposed above said platen and having a deposit area between opposed front and rear longitudinally directed walls against which recording media is stacked one on top of the other, said deposit tray having a lower end adjacent said platen defining an insertion opening, first and second transport rollers adjacent said lower end on opposed sides of said insertion opening, said first transport roller being driven for rotation, said second transport roller being supported by pivot means for selectively drawing said second transport roller across said insertion opening into driving nip relation with said first transport roller, said platen conducting recording media into said insertion opening during the printing thereof and said first and second transport rollers passing recording media fully into said deposit tray by said driving nip relation following the printing thereof, and means for stacking the recording media against either said front or rear walls, the selection of the wall against which the recording media is stacked being determined by the pivoted disposition of said deposit tray, said means comprising fixed bearing means coupled to said deposit tray such that said deposit tray is pivotable on said bearing means about a bearing axis.

2. The apparatus of claim 1, further comprising a sheet guide means in said deposit tray for deflecting recording media against either said front or rear walls depending upon the pivoted disposition of said deposit tray.

3. The apparatus of claim 2, wherein said sheet guide means comprises first and second pivotal flaps having pivot axes respectively disposed adjacent said front and rear walls for moving said flaps between positions parallel to said corresponding adjacent wall and extending toward said other opposed wall.

4. The apparatus of claim 1, wherein said first transport roller is supported in said bearing means and the rotational axis of said first transport roller coincides with said bearing axis.

5. The apparatus of claim 1, wherein said pivot means comprises a pivot arm having a pivot axis at one end and supporting a said second transport roller at its other end, a spring means connected to said pivot arm for biasing said second transport roller toward said first transport roller, and a controlled latch means for opposing said spring means bias.

* * * * *